US007825874B2

(12) United States Patent
Chung et al.

(10) Patent No.: US 7,825,874 B2
(45) Date of Patent: Nov. 2, 2010

(54) PLASMA DISPLAY PANEL INITIALIZATION AND DRIVING METHOD AND APPARATUS

(75) Inventors: Woo-Joon Chung, Suwon-si (KR); Seung-Hun Chae, Suwon-si (KR); Jin-Ho Yang, Suwon-si (KR); Jin-Sung Kim, Suwon-si (KR); Tae-Seong Kim, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 633 days.

(21) Appl. No.: 11/104,229

(22) Filed: Apr. 11, 2005

(65) Prior Publication Data

US 2005/0225508 A1 Oct. 13, 2005

(30) Foreign Application Priority Data

Apr. 12, 2004 (KR) ..... 10-2004-0024869

(51) Int. Cl.
*G09G 3/28* (2006.01)

(52) U.S. Cl. ..... 345/60; 345/67

(58) Field of Classification Search ..... 345/60–62, 345/67–68; 315/169.1, 169.3
See application file for complete search history.

(56) References Cited

U.S. PATENT DOCUMENTS 6,653,994 B2 * 11/2003 Takeda et al. ..... 345/60
6,853,145 B2 * 2/2005 Kang et al. ..... 315/169.1
7,012,579 B2 * 3/2006 Choi ..... 345/60
2003/0189534 A1 * 10/2003 Myoung et al. ..... 345/67

FOREIGN PATENT DOCUMENTS

| | | |
|---|---|---|
| CN | 1410960 | 4/2003 |
| JP | 2000-020021 | 1/2000 |
| JP | 2002-175043 | 6/2002 |
| JP | 2003-131614 | 5/2003 |
| JP | 2003-167548 | 6/2003 |
| JP | 2004-086076 | 3/2004 |

* cited by examiner

*Primary Examiner*—Chanh Nguyen
*Assistant Examiner*—Calvin C Ma
(74) *Attorney, Agent, or Firm*—Christie, Parker & Hale, LLP

(57) ABSTRACT

An initialization and driving method for a plasma display panel. When the plasma display panel is turned on, a voltage at a first electrode is increased from a first voltage to a second voltage, and a voltage at a second electrode is reduced from a fourth voltage to the fifth voltage for the purpose of forming wall charges in cells while a third voltage is applied to the second electrode. A voltage is applied to the first electrode and the second electrode to establish a difference between the first electrode and the second electrode to be alternately a sixth voltage and a negative voltage of the sixth voltage, and therefore the cell is discharged.

12 Claims, 7 Drawing Sheets

PLASMA DISPLAY PANEL INITIALIZATION AND DRIVING METHOD AND APPARATUS

CROSS REFERENCE TO RELATED APPLICATION

This application claims priority to and the benefit of Korean Patent Application No. 10-2004-0024869 filed on Apr. 12, 2004 in the Korean Intellectual Property Office, the entire content of which is incorporated herein by reference.

BACKGROUND OF THE INVENTION

1. Field of the Invention

The present invention relates to an initialization method for a plasma display panel (PDP).

2. Description of the Related Art

The PDP is a flat panel display for showing characters or images using plasma generated by gas discharge, and includes more than hundreds of thousands to millions of pixels arranged in a matrix format, in which the number of pixels are determined by the size of the PDP. The PDP is divided into a direct current (DC) PDP and an alternating current (AC) PDP according to an applied driving voltage waveforms and structures of discharge cells.

Electrodes of the DC PDP are exposed in a discharge space and the current flows in the discharge space when a voltage is applied, and therefore it is problematic to provide a resistor for current limitation. On the other hand, electrodes of the AC PCP are covered with a dielectric layer, so the current is limited because of natural formation of capacitance components and the electrodes are protected from ion impulses in the case of discharging. Therefore, the life span of the AC PDP is longer than that of the DC PDP.

Scan electrodes and sustain electrodes are formed in parallel on one side of the AC PDP, and address electrodes crossing the scan electrodes and the sustain electrodes are formed on the other side of the PDP. The sustain electrodes are formed corresponding to the scan electrodes, and a terminal of each sustain electrode is typically coupled to the other sustain electrodes in common.

FIG. 1 shows a partial perspective view of an AC PDP. The PDP includes two glass substrates 1, 6. Pairs of a scan electrode 4 and a sustain electrode 5 are formed in parallel on a first glass substrate 1, and are covered with a dielectric layer 2 and a protection film 3. A plurality of address electrodes 8 are established on a second glass substrate 6, and the address electrodes 8 are covered with an insulator layer 7. Barrier ribs 9 are formed in parallel with the address electrode 8 on the insulator layer 7 between the address electrodes 8, and phosphors 10 are formed on the surface of the insulator layer 7 and on the both sides of the barrier ribs 9. The glass substrates 1, 6 face each other with discharge spaces 11 between the glass substrates 1, 6 so that the scan electrodes 4 and the sustain electrodes 5 may respectively cross the address electrodes 8. A discharge space 11 between the address electrode 8 and a crossing part of a pair of the scan electrode 4 and the sustain electrode 5 forms a discharge cell 12.

FIG. 2 schematically shows an electrode arrangement of the AC PDP shown in FIG. 1. The electrodes of the AC PDP have an m×n matrix format. The address electrodes A1 to Am are arranged in a column direction, and n scan electrodes Y1 to Yn and sustain electrodes X1 to Xn are arranged in a row direction. The discharge cell 12 in FIG. 2 corresponds to the discharge cell 12 in FIG. 1.

In the conventional AC PDP, a frame is divided into a plurality of subfields in order to drive the PDP, and gray scales are represented by a combination of subfields.

A conventional method for driving the AC PDP has a reset period, an address period, and a sustain period represented by changes of the operation according to time. The state of each cell is initialized for properly performing an address operation in the reset period. An address voltage is applied to cells (addressed cells) to select the cells that are turned on and the cells that are turned off. Wall charges are accumulated to the cells that are turned on in the address period. Sustain pulses for discharge and display of images by the addressed cells is performed in the sustain period.

A voltage high enough to discharge the cell to be initialized is applied to each electrode in the reset period. However, the voltage is applied to generate a weak discharge for the purpose of uniformly controlling the state of the wall charges of the cells. In the reset period, the wall charges are so controlled such that no discharge is generated in the sustain period without the address period.

When the panel is turned on having no voltage applied to the electrodes of the panel, or the panel is turned on while the panel is turned off and the wall charges are not arranged properly, an insufficient discharge is generated in the few seconds when the panel is initialized.

The insufficient discharge is generated for a short time when the panel is initialized, and a lesser voltage is applied in the reset period because of brightness and reduction of a circuit cost. The insufficient discharge will be referred to as a discharge that is not maintained properly in the PDP. That is, the insufficient discharge may be generated when an address discharge is not generated properly in the address period because priming particles are lacking in a cell or the wall charge configuration is not controlled by the reset period.

The address discharge is formed in a short voltage-applying moment of 2-3 μs when a scan pulse and an address pulse are applied at the same time. The discharge is not easily performed when the priming particles are lacking in the cell. Accordingly, the rate at which insufficient discharge is generated is high when the panel that has been turned off for a long time is initialized. The insufficient discharge is generated because the state of the wall charges which are formed when the panel is turned off is not reset in the reset period even though the panel is immediately turned on, when the state of the wall charges is not predictable when the panel is turned off.

Conventionally, an initialization waveform for alternately applying high voltages have been used for the purpose of eliminating the insufficient discharge. This typically requires an additional power source of circuit which increases costs. Therefore, need still exists for an improved approach to eliminate insufficient discharge upon start-up of a PDP.

SUMMARY OF THE INVENTION

In accordance with the present invention an initialization method is provided for eliminating an insufficient discharge caused by an initialization of a PDP.

In one aspect of the present invention, an initialization method is applied when a PDP of which a discharge cell is formed by a first electrode and a second electrode is turned on. In the method, a) a voltage at the first electrode is increased from a first voltage to a second voltage, and wall charges is formed on the discharge cell by reducing a voltage at the second electrode from a fourth voltage to a fifth voltage while a third voltage is applied to the second electrode, and b) the discharge cell is discharged by applying a voltage to the first electrode and the second electrode in order to establish a difference between the first and the second electrodes of the discharge cell to be alternately a sixth voltage and a negative voltage of the sixth voltage.

When the PDP operates according to an input image signal, a subfield has a reset period, an address period, and a sustain period. In the reset period, a seventh voltage is applied to the second electrode, and the voltage at the first electrode is reduced from an eighth voltage to a ninth voltage. A difference between the third voltage and the fifth voltage is greater than a difference between the seventh voltage and the ninth voltage. The third voltage may be greater than the seventh voltage, and the fifth voltage may be less than the ninth voltage. The third voltage corresponds to a voltage applied to the second electrode in order to establish a voltage difference between the first electrode and the second electrode to be the sixth voltage.

In another aspect of the present invention, a plasma display includes a PDP of which a discharge cell is formed between a first electrode and a second electrode, a driving circuit for applying a driving voltage to the first electrode and the second electrode in a reset period, an address period, and a sustain period. The driving circuit applies a first voltage to the second electrode, reduces a voltage at the first electrode from a second voltage to a third voltage, and alternately applies a fourth voltage to the first electrode and the second electrode when the PDP is turned on.

In another aspect of the present invention, a method for driving a plasma display comprising a plurality of first electrodes and second electrodes is provided. In the method, when the plasma display is initially started, a first voltage which is obtained by subtracting a voltage of the first electrode from a voltage of the second electrode is gradually increased from a second voltage to a third voltage, the first voltage is gradually reduced from a fourth voltage to fifth voltage, the first voltage is established to be a positive sixth voltage, the first voltage is established to be a negative seventh voltage. In a reset period when the plasma display is normally operated, the first voltage is gradually increased from an eighth voltage to a ninth voltage, and the first voltage gradually reduced from a tenth voltage to an eleventh voltage.

DETAILED DESCRIPTION

Figure 1:
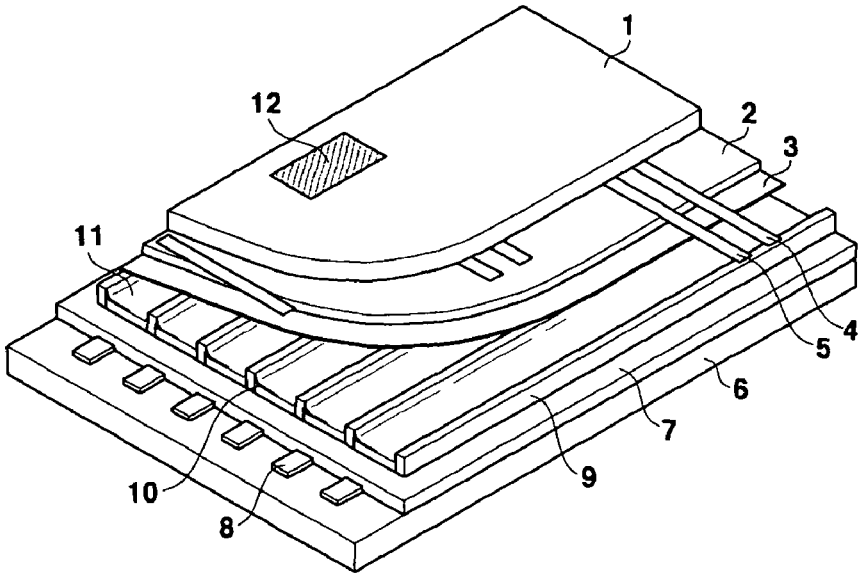
FIG.1 (Prior Art)
FIG. 1 shows a partial perspective view of an AC PDP.
Figure 2:
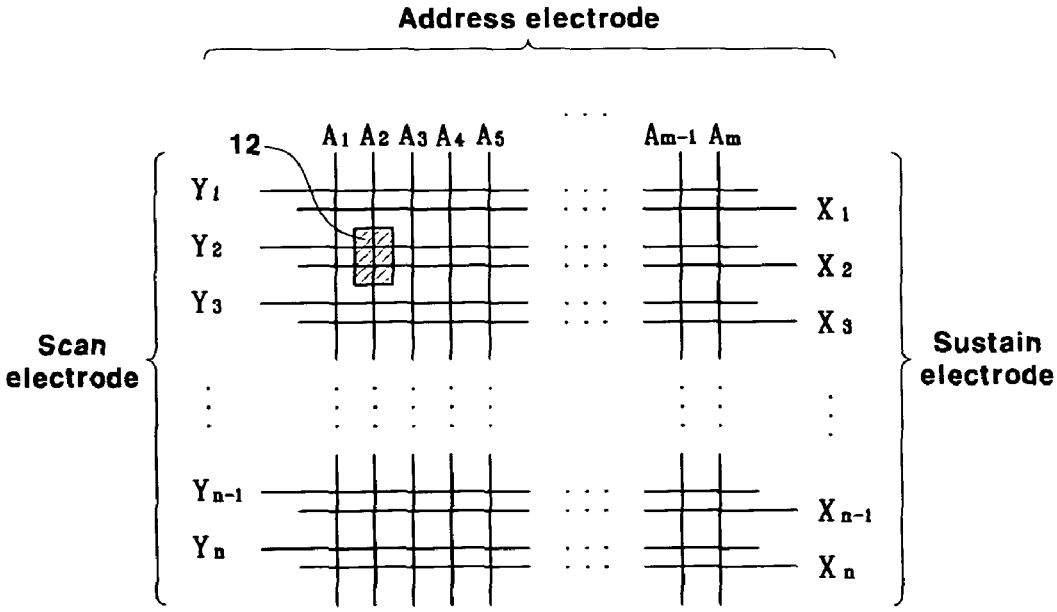
FIG.2 (Prior Art)
FIG. 2 schematically shows an electrode arrangement of the AC PDP of FIG. 1.
Figure 3:
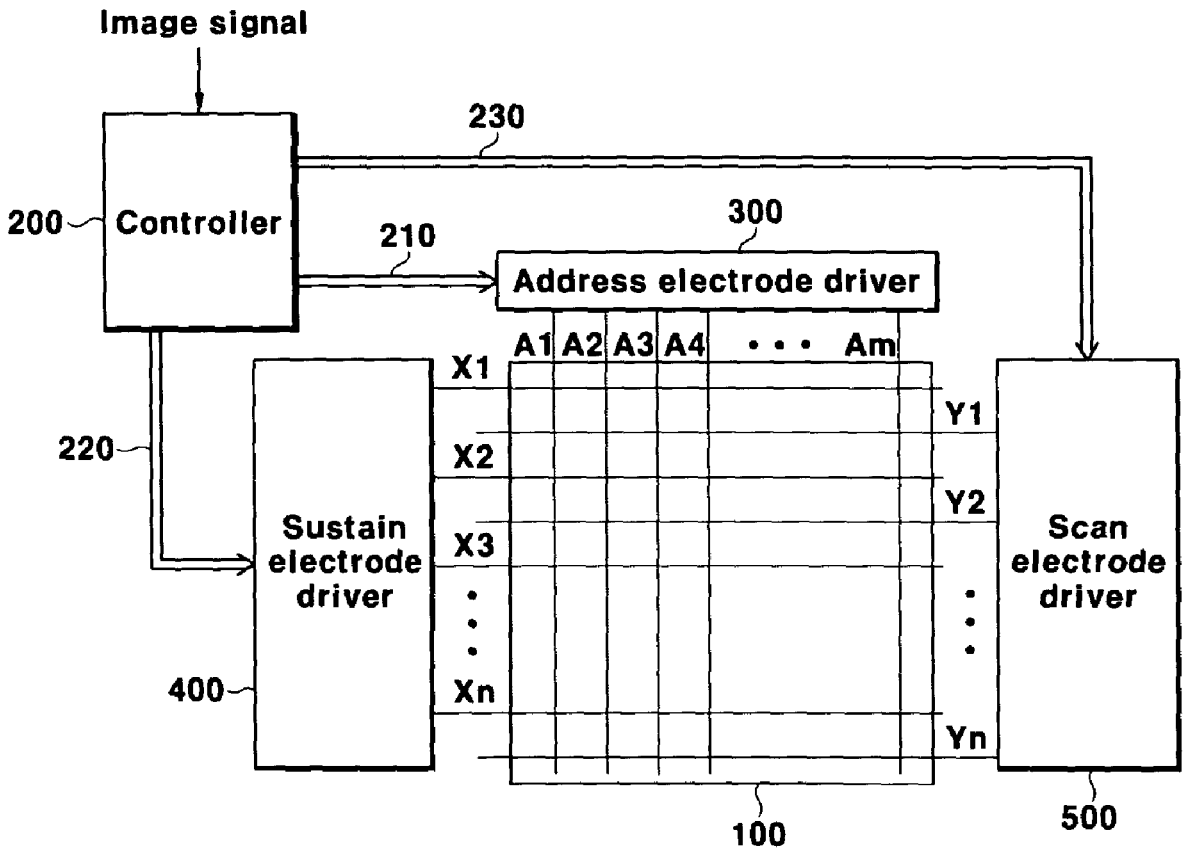
FIG. 3 shows a simplified diagram for representing a PDP according to an exemplary embodiment of the present invention.

Referring now to FIG. 3, the PDP according to an exemplary embodiment of the present invention includes a plasma panel 100, a controller 200, an address electrode driver 300, a sustain electrode driver 400, and a scan electrode driver 500.

The PDP 100 includes a plurality of address electrodes A1 to Am arranged in a column direction, a plurality of sustain electrodes X1 to Xn and scan electrodes Y1 to Yn arranged in a row direction.

The controller 200 externally receives an image signal and outputs an address driving control signal 210, a sustain electrode X driving control signal 220, and a scan electrode Y driving control signal 230. The address electrode driver 300 receives the address driving control signal 210 from the controller 200 and applies a display data signal for selecting a discharge cell to be displayed to the address electrodes. The sustain electrode driver 400 receives the sustain electrode X driving control signal 220 from the controller 200 and applies a driving voltage to the sustain electrodes X. The scan electrode driver 500 receives the scan electrode Y driving control signal 230 from the controller 200 and applies the driving voltage to the scan electrodes Y.

Figure 4A:
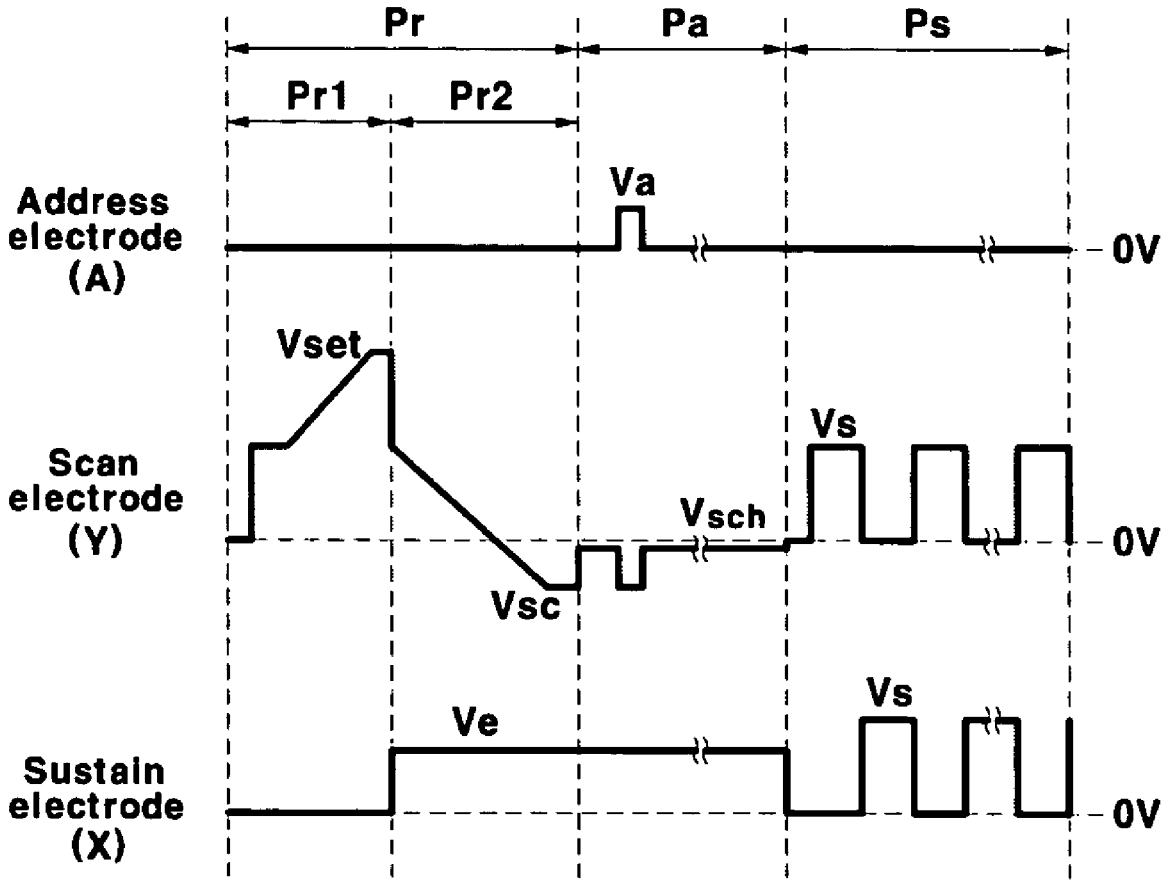
FIGS. 4A and 4B show driving waveforms of a PDP according to exemplary embodiments of the present invention.
Figure 4B:
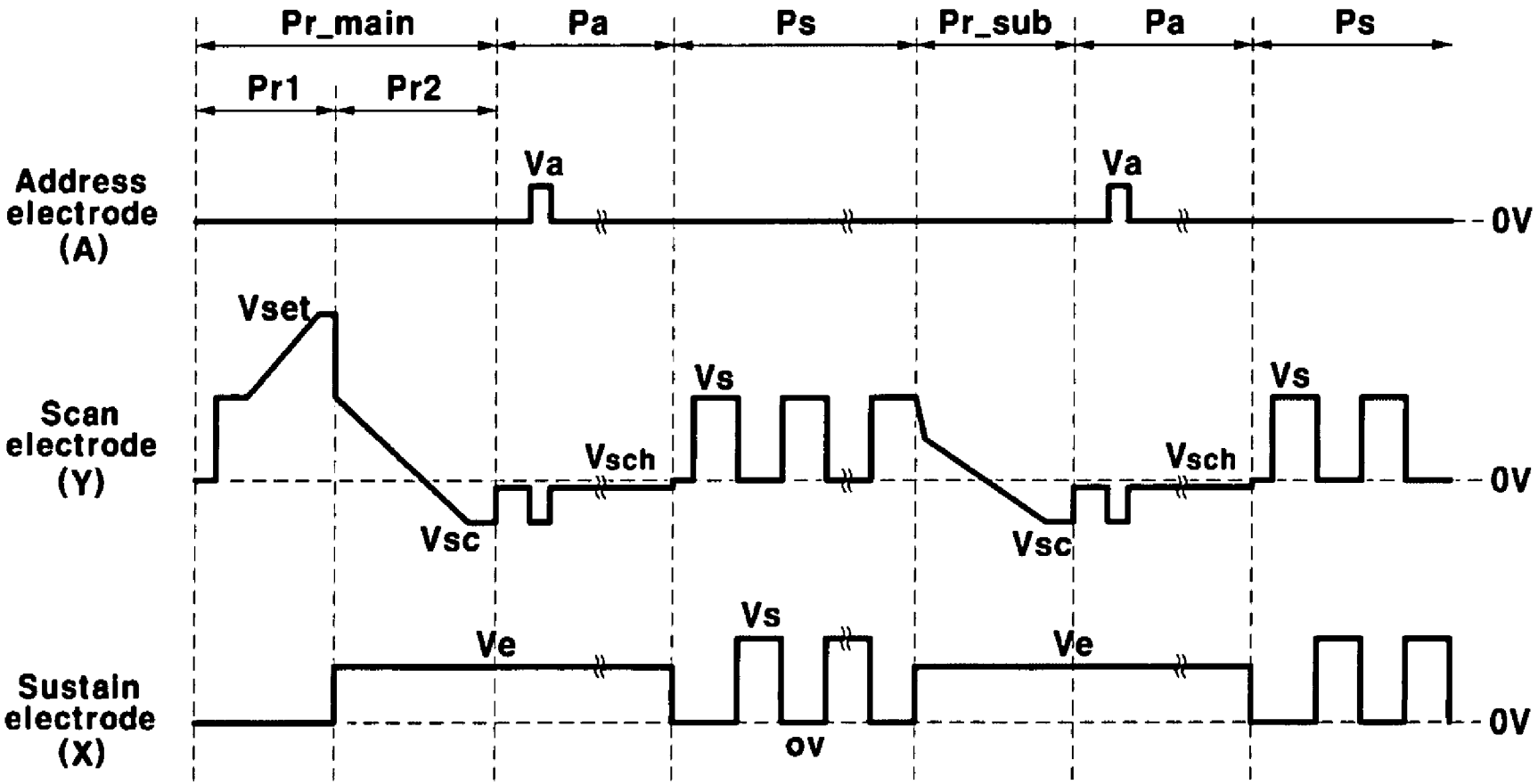

FIGS. 4A and 4B show driving waveforms of a PDP according to an exemplary embodiment of the present invention.

Referring first to FIG. 4A, a frame is divided into a plurality of subfields and is driven. Each subfield has a reset period $P_r$, an address period $P_a$, and a sustain period $P_s$. The reset period has a rising ramp period $P_r$, and a falling ramp period $P_{r2}$.

The rising ramp period $P_{r1}$ of the reset period $P_r$ forms wall charges on the scan electrodes Y, the sustain electrodes X, and the address electrodes A. The falling ramp period $P_{r2}$ of the reset period $P_r$ eliminates the wall charges formed in the rising ramp period $P_{r1}$ to make the address discharge easy. The address period $P_a$ selects a cell to be sustain-discharged from among the discharge cells in the sustain period. The sustain period $P_s$ applies sustain pulses to the scan electrodes Y and the sustain electrodes X in sequence, and performs a sustain-discharge of the discharge cell selected in the address period $P_a$.

The PDP is coupled to a scan/sustain driving circuit for applying the driving voltage to the scan electrodes Y and the sustain electrodes X in the respective periods $P_r$, $P_a$, and $P_s$, and an address driving circuit for applying the driving voltage to the address electrodes A, and therefore, the PDP forms a display.

As shown in FIG. 4A, the rising ramp period $P_{r1}$ of the reset period $P_r$ maintains the address electrodes A and the sustain electrodes X to be a voltage of 0V, and applies a ramp voltage gradually rising from a voltage of $V_s$ to a voltage of $V_{set}$ to the scan electrode Y. A weak reset discharge is generated in the discharge cells from the scan electrodes Y to the address electrodes A and the sustain electrodes X while the ramp voltage is rising. As a result, (−) wall charges are formed on the scan electrodes Y and (+) wall charges are formed on the address electrodes A and the sustain electrodes X.

The wall charges indicate charges formed on a wall (e.g. a dielectric layer) of discharge cells neighboring each electrode and accumulated to electrodes. Although the wall charges are do not substantially touch the electrodes, it will be described that the wall charges are "generated", "formed", or "accumulated" thereon. Also, a wall voltage represents a potential difference formed on the wall of the discharge cells by the wall charges.

In the ramp falling period $P_{r2}$ of the reset period $P_r$, a ramp waveform gradually falling to a voltage of $V_{sc}$ which is a negative voltage from the voltage of $V_s$ is applied to the scan electrode Y while the sustain electrode X is maintained at a voltage of $V_e$ which is a static voltage. When a voltage of $V_f$ represents a discharge firing voltage in the discharge cell, a difference between the wall voltage and a voltage applied to the scan electrode Y and the sustain electrode X exceeds the discharge firing voltage $V_f$ when the voltage applied to the scan electrode is reduced and a predetermined wall voltage is formed on the scan electrode and the address electrode in the rising ramp period. At this time, the wall charges are eliminated because the weak reset discharge is generated in the discharge cells. Conventionally, the voltage of $(V_e-V_{sc})$ is applied to the discharge firing voltage between the sustain electrode X and the scan electrode Y, and the wall voltage between the sustain electrode X and the scan electrode Y is established to be the voltage of 0V.

In the address period $P_a$, the voltage of $V_{sc}$ is applied to the scan electrode Y in sequence so as to select the scan electrode Y while the sustain electrode X and the other scan electrodes Y are respectively maintained at the voltage of $V_e$ and the voltage of $V_{sch}$. An address voltage $V_a$ is applied to the address electrode A for forming the discharge cell to be selected from the discharge cells formed by the scan electrode Y to which the negative voltage of $V_{sc}$ is applied. The address discharge is generated between the address electrode A and the scan electrode Y, and between the sustain electrode X and the scan electrode Y by the difference between the voltage of $V_a$ applied to the address electrode A and the voltage of $V_{sc}$ applied to the scan electrode Y, and by the wall voltage caused by the wall charges formed on the address electrode A and the scan electrode Y. Therefore, (+) wall charges are formed on the scan electrode Y, and (−) wall charges are formed on the sustain electrode X.

In the sustain period $P_s$, the sustain pulse is applied to the scan electrode Y and the sustain electrode X in sequence. Each sustain pulse provides a voltage alternating between the voltage of $V_s$ and a 0 voltage. The voltage of $V_s$ is less than the discharge firing voltage between the scan electrode Y and the sustain electrode X. The discharge is generated on the scan electrode Y and the sustain electrode X by the wall voltage and the voltage of $V_s$ when the wall voltage is formed between the scan electrode Y and the sustain electrode X by the address discharge in the address period $P_a$.

Referring now to FIG. 4B, a main reset period $P_{r_main}$ is formed in a first subfield of a plurality of the subfields forming a frame, and a sub-reset period $P_{r_sub}$ is formed in a next subfield. In the main reset period $P_{r_main}$ which is a reset period of a first subfield, a rising ramp waveform is applied and a falling waveform is applied. In the sub-reset period $P_{r_sub}$ which is a reset period of a subfield after the first subfield, only a falling ramp waveform is applied.

As described above, the rising ramp waveform is applied to the scan electrode Y for the purpose of forming significant wall charges in the discharge cell in the reset period. However, in the second subfield, it is not necessary to form the wall charges in the reset period because significant wall charges are formed by the sustain-discharge in the discharge cell emitted in the sustain period of the previous subfield. Also, it is not necessary to perform a reset operation in the subfield after the second subfield because the state of the wall charges formed in the reset period is not varied in the discharge cell which is not emitted in the sustain period. At this time, the discharge is not generated when a falling ramp waveform is applied to the scan electrode Y, and therefore the discharge cell is maintained at the reset state. Based on a frame, the main reset period $P_{r_main}$ is only provided in the first subfield and not in other subfields.

In the exemplary embodiment of the present invention, an initialization waveform for eliminating the insufficient discharge generated by power-on of the PDP is provided.

The initialization waveforms of the PDP according to first and second exemplary initialization embodiments of the present invention will now be described with reference to FIGS. 5 and 6. The initialization waveforms of the PDP according to the exemplary initialization embodiments of the present invention have a period $P_{rr}$ for generating the wall charges of the cells and a period $P_{ss}$ for discharging the cells.

The period $P_{rr}$ for generating the wall charges of the cells forms the wall charges so as to generate the discharge in the cells by applying the sustain pulse in the period $P_{ss}$ for discharging the cells without the address period for selecting the discharge cell which generates the sustain-discharge in the sustain period. The period $P_{ss}$ for discharging the cells applies the sustain pulses to the scan electrode Y and the sustain electrode X in sequence, and discharges the cells.

The period $P_{rr}$ for generating the wall charges of the cells has a voltage rising period and a voltage falling period.

The voltage rising period $P_{rr1}$ of the period $P_{rr}$ for generating the wall charges of the cells maintains the address electrode A and the sustain electrode X to be the voltage of 0V, and applies a ramp voltage gradually rising from the voltage of $V_s$ to the voltage of $V_{set}$ to the scan electrode Y. A weak reset discharge is respectively generated from the scan electrode Y to the address electrode A and the sustain electrode X in the discharge cells while the ramp voltage is rising. Accordingly, the (−) wall charges are formed on the scan electrode Y while the (+) wall charges are formed on the sustain electrode X.

Figure 5:
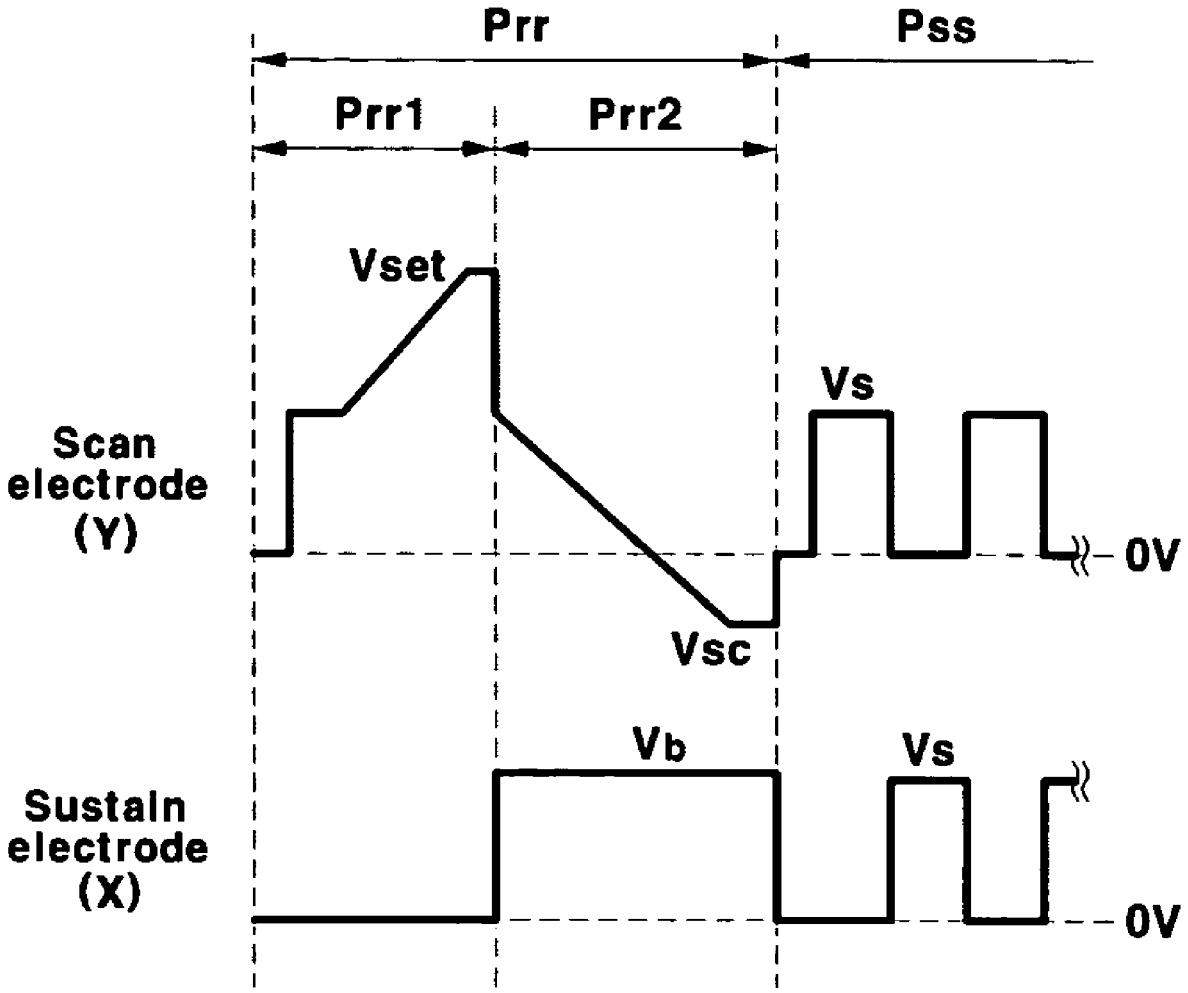
FIG. 5 shows initialization waveforms of a PDP according to a first exemplary initialization embodiment of the present invention.

Now referring to FIG. 5, the voltage falling period $P_{rr2}$ of the period $P_{rr}$ for generating the wall charges of the cells applies a ramp voltage gradually falling to the voltage of $V_{sc}$ from the voltage of $V_s$ to the scan electrode Y.

$$|Vb-Vsc|>|Ve-Vsc| \quad \text{[EQUATION 1]}$$

As shown in Equation 1, a final apply voltage between the scan electrode Y and the sustain electrode X in the voltage falling period $P_{rr2}$ of the period $P_{rr}$ for generating the wall charges of the cells is greater than a final apply voltage between the scan electrode Y and the sustain electrode X in the falling ramp period in FIGS. 4A and 4B. The discharge is generated when the wall voltage which is formed in the period $P_{rr}$ for generating the wall charges of the cells while the voltage applied to the scan electrode is gradually reduced and a difference between the voltages applied to the scan electrode Y and the sustain electrode are greater than the discharge firing voltage, and the wall voltage between the sustain electrode X and the scan electrode Y may reach 0V when the difference between the voltages applied to the scan electrode Y and the sustain electrode X is reduced to the discharge firing voltage $-V_f$ for generating the discharge between the sustain electrode X and the scan electrode Y.

The wall voltage is increased because the (+) wall charges are formed on the scan electrode Y and the (−) wall charges are formed on the address electrode A and the sustain electrode X when the difference between the voltages applied to the scan electrode Y and the sustain electrode X is less than the voltage of $-V_f$. Therefore, an operation corresponding to the address discharge in the address period of the driving waveform as described in FIGS. 4A and 4B is performed. At this time, the voltage of $V_b$ establishes the value of $|V_b-V_{sc}|$ to be the value for generating the discharge when the sustain pulse is applied after the period $P_{rr}$ for generating the wall charges of the cells.

The sustain pulses are sequentially applied to the scan electrode Y and the sustain electrode X in the period $P_{ss}$ for discharging the cells in the like manner of the driving waveforms in FIGS. 4A and 4B. The discharge is generated on the scan electrode Y and the sustain electrode X in the discharge cells by the voltage of $V_s$ generated by the sustain pulse and the wall voltage generated by the wall charges accumulated in the period for generating the wall charges in the cells. An initial insufficient discharge is eliminated because enough discharge priming particles are provided to the cells by the discharge and the wall charges in the cells are provided in the area that may be controlled.

It is necessary to provide an additional power source for supplying the voltage of $V_b$ because the voltage of $V_b$ which is greater than the voltage of $V_e$ is applied to the sustain electrode X for the purpose of establishing the final apply voltage of $|V_b-V_{sc}|$ in the voltage falling period $P_{rr2}$ to be greater than the discharge firing voltage. The voltage of $V_s$ may be applied to the sustain electrode X instead of the voltage of $V_b$. As such, it is not necessary to provide an additional power source.

The voltage applied to the sustain electrode X in the voltage falling period $P_{rr2}$ is varied in order to eliminate the insufficient discharge in the first exemplary initialization embodiment of the present invention. However, another exemplary initialization embodiment will be possible and is described with reference to FIG. 6.

Figure 6:
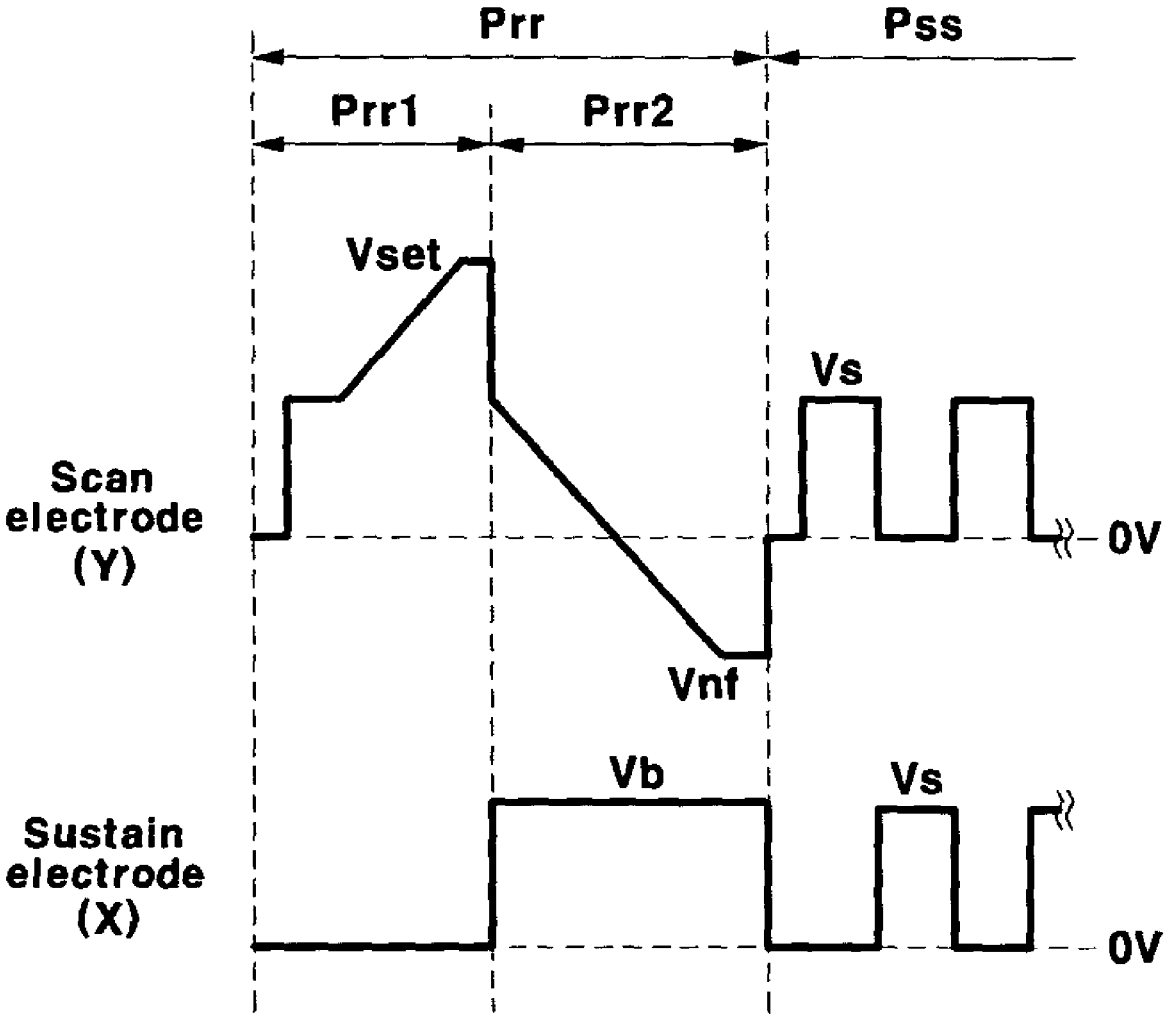
FIG. 6 shows initialization waveforms of a PDP according to a second exemplary initialization embodiment of the present invention.

FIG. 6 shows initialization waveforms of a PDP according to a second exemplary initialization embodiment of the present invention. A ramp voltage gradually falling to the voltage of $V_{nf}$ which is less than the voltage of $V_{sc}$ applied in the voltage falling period $P_r$ in FIG. 5 is applied in the voltage falling period $P_{rr2}$ of the period $P_{rr}$ for generating the wall charges of the cells in the initialization waveform of the PDP according to the second exemplary initialization embodiment of the present invention.

$$|Vb-Vnf|>|Vb-Vsc|>|Ve-Vsc| \quad \text{[EQUATION 2]}$$

As shown Equation 2, a final apply voltage between the scan electrode Y and the sustain electrode X in the voltage falling period $P_{rr2}$ is greater than a final apply voltage between the scan electrode Y and the sustain electrode X in the falling ramp period $P_{rr2}$ in FIG. 5. Therefore, more wall charges are formed than those in FIG. 5. That is, the discharge is generated although the sustain pulse is applied, because the quantity of wall charges accumulated on the scan electrode Y and the sustain electrode X to be eliminated is reduced compared to that in the driving waveform in FIG. 5.

Alternatively, the voltage of $V_e$ may be applied to the sustain electrode X and the voltage of $V_{nf}$ may be applied to the scan electrode Y.

The initialization driving waveforms of the PDP according to the exemplary embodiments of the present invention are applied when the PDP is turned on. In addition, the initialization waveforms shown in FIGS. 5 and 6 may be applied to the PDP more than once before the driving waveforms shown in FIGS. 4A and 4B are applied to the PDP. Therefore, the stable initialization operation is performed by alternately applying the sustain pulse which is less than the discharge firing voltage without providing a power source or separate circuit for the initialization operation.

Figure 7:
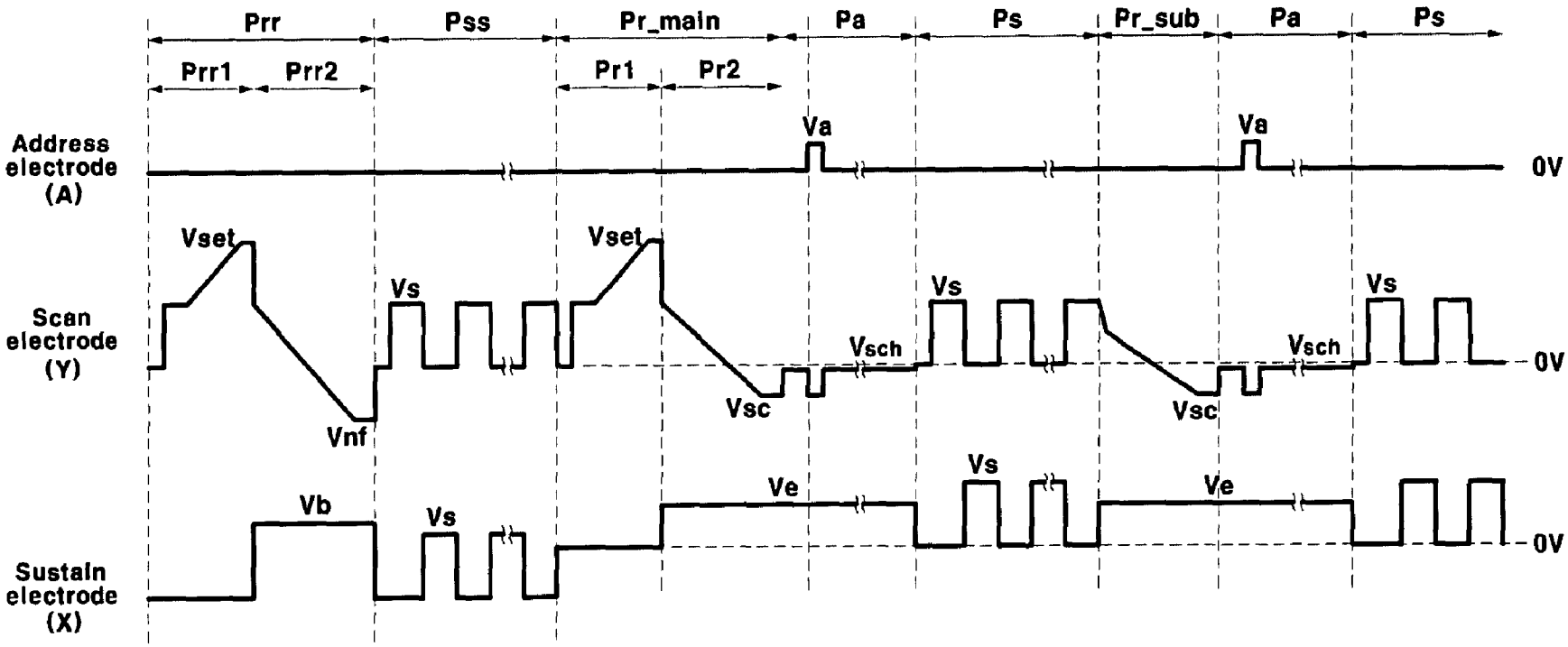
FIG. 7 shows waveforms of a PDP according to an exemplary embodiment of the present invention.

Next, whole waveforms of the PDP will be described with reference to FIG. 7. FIG. 7 shows waveforms of the PDP according to the exemplary embodiment of the present invention.

As shown in FIG. 7, the initialization waveforms of FIG. 6 are applied to the PDP when the PDP is turned on, and then the driving waveforms of FIG. 4B are applied to the PDP.

The voltage at the scan electrode Y is gradually reduced as a ramp type in the first and the second exemplary initialization embodiments of the present invention. However, the voltage may be varied as a step type, and waveforms in which a pulse and floating are alternated and waveforms varied according to time of an RC (register-capacitor) may be applied.

According to the present invention, stability and reliability of a circuit's operation are increased because current peak, element stress, electromagnetic interference (EMI), and noise are reduced by preventing rapid voltage variation in the reset period.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. A method for driving a plasma display panel having a discharge cell formed by a first electrode and a second electrode, the method comprising:

during initialization at turn on of the plasma display panel, in a reset period, increasing a voltage at the first electrode from a first voltage to a second voltage, reducing a voltage at the first electrode from a fourth voltage to a fifth voltage while a third voltage is applied to the second electrode, and thus forming wall charges on the discharge cell; and in a sustain period immediately following the reset period, discharging the discharge cell by applying a voltage to the first electrode and the second electrode to establish a voltage obtained by subtracting the voltage at the first electrode from the voltage at the second electrode of the discharge cell to alternately be a sixth voltage and negative voltage of the sixth voltage, wherein when the plasma display panel discharges cells in response to an input image signal driven by frames, a frame having a plurality of subfields, a subfield having a reset period, an address period, and a sustain period, in the reset period, a seventh voltage is applied to the second electrode and the voltage at the first electrode is reduced from an eighth voltage to a ninth voltage, and wherein a difference between the third voltage and the fifth voltage is greater than a difference between the seventh voltage and the ninth voltage.

2. The method of claim 1, wherein the third voltage is greater than the seventh voltage.

3. The method of claim 1, wherein the fifth voltage is less than the ninth voltage.

4. The method of claim 1, wherein the third voltage corresponds to a voltage applied to the second electrode to establish a voltage difference between the first electrode and the second electrode to be the sixth voltage.

5. The method of claim 1, wherein a voltage is applied to the first electrode and the second electrode to establish a voltage obtained by subtracting the voltage at the first electrode from the voltage at the second electrode to alternately be the sixth voltage and a negative voltage of the sixth voltage in the sustain period.

6. A plasma display comprising:

a plasma display panel having a discharge cell formed between a first electrode and a second electrode; and a driving circuit adapted to apply a driving voltage to the first electrode and the second electrode in an initialization period when the plasma display is turned on, and in a frame comprising a plurality of subframes, each subframe comprising a reset period, an address period, and a sustain period, wherein during a reset period of the initialization period, the driving circuit applies a first voltage to the second electrode and reduces a voltage at the first electrode from a second voltage to a third voltage, and during a sustain period of the initialization period immediately following the reset period of the initialization period, alternately applies a fourth voltage to the first electrode and the second electrode, wherein a fifth voltage is applied to the second electrode, and the voltage at the first electrode is reduced from a sixth voltage to a seventh voltage in the reset period, and a difference between the first voltage and the third voltage is greater than a difference between the fifth voltage and the seventh voltage.

7. The plasma display of claim 6, wherein the fourth voltage corresponds to a sustain-discharge voltage which is applied to the first electrode in the sustain period.

8. A method for driving a plasma display having a plurality of first electrodes and second electrodes, the method comprising:

in a reset period of an initialization at turn on of the plasma display, gradually increasing a first voltage which is obtained by subtracting a voltage of the second electrode from a voltage of the first electrode, from a second voltage to a third voltage; and gradually reducing the first voltage from a fourth voltage to a fifth voltage;

in a sustain period of the initialization, immediately following the reset period of the initialization, establishing the first voltage to be a positive sixth voltage; and establishing the first voltage to be a negative seventh voltage, and in a reset period when the plasma display is normally operated, gradually increasing the first voltage from an eighth voltage to a ninth voltage; and gradually reducing the first voltage from a tenth voltage to an eleventh voltage, wherein a difference between the third voltage and the fifth voltage is greater than a difference between the ninth voltage and the eleventh voltage.

9. The method of claim 8, wherein the fifth voltage is less than the eleventh voltage.

10. The method of claim 9, wherein the voltage of the second electrode is maintained at a twelfth voltage when the first voltage is reduced from the fourth voltage to the fifth voltage and the voltage of the second electrode is maintained at a thirteenth voltage which is less than the twelfth voltage when the first voltage is reduced from the tenth voltage to the eleventh voltage.

11. The method of claim 9, wherein the voltage of the first electrode is reduced from a fourteenth voltage to a fifteenth voltage while the voltage of the second electrode is maintained at a twelfth voltage when the first voltage is reduced from the fourth voltage to the fifth voltage, and the voltage of the first electrode is reduced from the fourteenth voltage to a sixteenth voltage which is higher than the fifteenth voltage while the voltage of the second electrode is maintained at a thirteenth voltage when the first voltage is reduced from the tenth voltage to the eleventh voltage.

12. The method of claim 10, wherein the voltage of the first electrode is reduced from a fourteenth voltage to a fifteenth voltage when the first voltage is reduced from the fourth voltage to the fifth voltage, and the voltage of the first electrode is reduced from the fourteenth voltage to the fifteenth voltage when the first voltage is reduced from the tenth voltage to the eleventh voltage.

* * * * *